US005412850A

United States Patent [19]

Miranda

[11] Patent Number: 5,412,850

[45] Date of Patent: May 9, 1995

[54] JEWELRY CLASP

[76] Inventor: Richard A. Miranda, P.O. Box 71, Lake Worth, Fla. 33460

[21] Appl. No.: 186,009

[22] Filed: Jan. 24, 1994

[51] Int. Cl.[6] ..... A44B 11/00

[52] U.S. Cl. ..... 24/616; 24/656; 24/658

[58] Field of Search ..... 24/656, 657, 658, 615, 24/616, 116 A, 3 K, 116 R; 63/2, DIG. 1; 403/325

[56] References Cited

U.S. PATENT DOCUMENTS

| | | | |
|---|---|---|---|
| 753,486 | 3/1904 | Hansen . | |
| 941,096 | 11/1909 | Pugatsky et al. . | |
| 1,232,733 | 7/1917 | Swedlund | 24/616 |
| 1,608,807 | 11/1926 | Ogush . | |
| 2,032,196 | 2/1936 | Blake | 403/325 |
| 2,599,660 | 6/1952 | Poutinen | 24/3 K |
| 2,725,610 | 12/1955 | Smith . | |
| 3,092,885 | 6/1963 | Guanche | 24/616 |
| 3,611,513 | 10/1971 | Hoober et al. | 24/658 |
| 4,220,016 | 9/1980 | Frenger | 63/DIG. 1 |
| 4,310,953 | 1/1982 | Nanasi . | |
| 4,358,876 | 11/1982 | Colognori | 24/616 |
| 4,532,682 | 8/1985 | Murao | 24/616 |
| 4,675,955 | 6/1987 | Nakamura . | |
| 5,075,936 | 12/1991 | Glaser | 24/615 |
| 5,191,685 | 3/1993 | Aoki et al. . | |

FOREIGN PATENT DOCUMENTS

| | | | |
|---|---|---|---|
| 0641902 | 8/1928 | France | 24/656 |
| 0668876 | 11/1929 | France | 24/658 |

*Primary Examiner*—Victor N. Sakran
*Attorney, Agent, or Firm*—Basile and Hanlon

[57] ABSTRACT

A clasp includes releasibly interconnectible first and second clasp members. The first clasp member includes an outwardly extending lock member. The second clasp member includes an inner tubular member slidably mounted in an outer tubular member. A lock member receiver is formed on the inner tubular member and, in a normal biased position of the inner tubular member, closes an aperture formed in a side wall of the outer tubular member to lockingly engage the lock member inserted through the aperture to join the first and second clasp members together. At least one and preferably a pair of diametrically opposed slots or grooves extend axially from one end of the inner tubular member and engage a pin mounted diametrically across the outer tubular member or projections formed on the outer tubular member, respectively, for guiding and limiting the sliding movement of the inner tubular member within the outer tubular member. Alternately, tabs are formed in the inner tubular member and are deformable into the slots or grooves. An end cap is fixed to an end of the inner tubular member normally extending outward from one end of the outer tubular member. Depression of the end cap causes sliding movement of the inner tubular member in one direction resulting in the lock member receiver opening the aperture in the outer tubular member to enable the lock member to be separated from the outer tubular member or, alternately, to be inserted into the outer tubular member.

21 Claims, 5 Drawing Sheets

JEWELRY CLASP

BACKGROUND OF THE INVENTION

1. Field of the Invention

The present invention relates, in general, to clasps or fasteners for releasibly securing two elements together, and specifically, to clasps for securing the ends of jewelry, such as necklaces, bracelets, watch bands, etc. together.

2. Description of the Art

Clasps are used to secure two elements, such as the ends of jewelry, for example, necklaces, bracelets, watch bands etc., together around the neck, arm, etc., of a user. Typically, one clasp member is connected to one end of the piece of jewelry and includes a movable member which selectively moves between open and closed positions to receive a mating clasp member attached to the other end of the piece of jewelry.

A typical clasp previously created by the present inventor is shown in FIGS. 1 and 2. This clasp 10 includes a hollow, outer tubular member 12 having a loop 14 connected to a flange 15 extending outward from a side wall of the tubular member 12 which is attached by a pin or other fastener means, not shown, to one end of a bracelet, necklace, etc. An aperture 16 is formed in the side wall of the tubular member 12 intermediate the opposed ends thereof and opens to the interior of the tubular member.

A planar member 18 is slidably mounted in the tubular member 12. An irregularly shaped opening 20 is formed in the planar member 18 leaving an arm 22 which extends axially along one side of the planar member 18 in the direction of movement of the planar member 18. The end of the arm 22 is spaced from an opposed portion of the planar member 18. A disk 24 is soldered onto one end of the planar member 18 to form a seat for a coil spring 26 which is disposed within the tubular member 12 between the disk 24 and another disk 25 which is press fit within an end cup 28 affixed to one end of the tubular member 12 after the spring 26 has been inserted into the tubular member 12.

The coil spring 26 biases the planar member 18 toward the opposite end 32 of the tubular member 12. A C-ring 30 and a split ring 31 are fixedly mounted in a spaced apart manner within the tubular member 12 to limit the axial movement of the planar member 18 toward the end 32 of the tubular member 12 and, in the case of the split ring 31, to also limit the angular movement of the planar member 18 within the tubular member 12.

In a normal position shown in FIG. 2, the coil spring 26 biases the planar member 18 such that one end 34 of the planar member 18 extends outward beyond the end 32 of the tubular member 12 where the end 34 of the planar member 18 is fixedly joined to an end cap 36. Also, in this normal position, the arm 22 on the planar member 18 extends across the aperture 16 in the tubular member 12. Depression of the end cap 36 to the right, as viewed in the orientation shown in FIG. 2, slidably urges the planar member 18 to the right against the coil spring 26 until the arm 22 on the planar member 18 is spaced from the aperture 16. This opens the aperture 16 for insertion or removal of a latch member 38, shown in FIG. 1, which is typically in the form of an arch-shaped member mounted on a mating clasp member 40 attached to the other end of the piece of jewelry.

After the latch member 38 is inserted through the aperture 16 in the outer tubular member 12, subsequent release of the end cap 36 enables the coil spring 26 to urge the planar member 18 to the left, as viewed in FIG. 2, until the arm 22 passes interiorly through the latch member 38 and across the aperture 16 in the tubular member 12 to fixedly connect the tubular member 12 to the mating clasp member 40. Further, decorative elements 37 may be mounted in the end cup 28 and the end cap 36.

While this clasp 10 securely joins the ends of a bracelet, necklace, etc., together, it requires time consuming labor to properly position the C-ring 30 and the split ring 31 at the proper position inside of the tubular member 12. In addition, the soldering of the circular end cap 36 to one end 34 of the planar member 18 forms a relatively weak joint between these two components which is susceptible to breakage. Another weak point is the soldered connection between the end of the relatively thin planar member 18 and the disk 24.

The same problems confront another prior art clasp which is partially shown in FIG. 17. This prior art clasp is substantially the same as the prior art clasp described above and shown in FIG. 1 with two exceptions. In this clasp, the planar member 18 lacks an arm 22. The latch feature is provided by an arcuate member 110 which is secured by soldering, etc., to the bottom edge of the first end of the planar member 18 adjacent to the disk 24. The arcuate member 110 has side edge portions which extend outwardly from opposite sides of the planar member 18 and slidably engage a latch member 111 formed on the first clasp member 40. The latch member 111 is formed of first and second, inverted, L-shaped members 112 and 114, each having a first leg 116 attached to and extending outwardly from one surface of the clasp member 40. An inwardly extending leg 118 extends generally perpendicular from the outer end of the first leg 116 and extends toward but is spaced from the second leg 118 of the opposite L-shaped member 112 or 114. The L-shaped members 112 and 114 form an opening therebetween through which the arcuate member 110 on the planar member 18 slidably extends, in the same manner as described above, to releasably connect the clasp member 40 to the tubular member 12 in which the planar member 18 is mounted.

Thus, it would be desirable to provide a clasp which has a strong connection between its components and which requires less labor to assemble due to a simplified construction and fewer parts.

SUMMARY OF THE INVENTION

The present invention is a clasp for releasibly securing two movable members, such as the opposed ends of a piece of jewelry together.

The present clasp includes first and second releasibly interconnectible clasp members. The first clasp member has a lock member extending outward therefrom. The second clasp member is in the form of a hollows outer tubular member having a side wall extending between first and second opposed ends. An aperture is formed in the side wall between the first and second ends for slidably receiving the lock member of the first clasp member therethrough.

An inner tubular member is slidably mounted in the outer tubular member and has first and second opposed ends. A lock member receiving means is integrally formed on the inner tubular member for releasingly receiving the lock member therein. In one embodiment, the lock member comprises a ring having an aperture, and the lock member receiving means is in the form of a lock arm integrally formed in the inner tubular member. One end of the lock arm is spaced from an adjacent intermediate portion of the inner tubular member by a gap at least as wide as the width of the aperture in the outer tubular member.

In another embodiment, the lock member comprises a spherical ball mounted on a smaller diameter or width stem attached to the first clasp member. The lock member receiving means, in this embodiment, has a keyhole slot formed therein with an enlarged diameter first end and a narrower slot extending from the first end for slidably receiving the stem on the first class member. In yet another embodiment, a polygonal-shaped member is mounted on a stem attached to the first clasp member. The lock member receiving means on the inner tubular member has an aperture formed complimentary to the shape of the polygonal member and a narrow slot extending therefrom for receiving the stem on the lock member attached to the first clasp member.

An end cup is fixedly mounted or integrally formed on the first end of the outer tubular member. A biasing means is disposed in the outer tubular member and seated between a disk press fit in the end cup at the juncture of the end cup and one end of the outer tubular member and the first end of the inner tubular member. Alternately, the first end of the outer tubular member or the first end cup is closed to form a seat for one end of the biasing means. The biasing means biases the inner tubular member toward the second end of the outer tubular member to normally dispose the second end of the inner tubular member exteriorly outward from the second end of the outer tubular member and, at the same time, to normally position the lock member receiving means on the inner tubular member across the aperture in the outer tubular member. An end cap is fixedly secured to the second end of the inner tubular member exteriorly of the second end of the outer tubular member.

Guide means are formed on the inner and outer tubular members and coact for guiding the sliding movement of the inner tubular member between a first, normal position in which the lock arm or the narrow slot portion of the lock member receiving means extends across the aperture in the side wall of the outer tubular member and engages the lock member on the first clasp member to securely interconnect the first and second clasp members together and a second position, upon movement of the end cap toward the second end of the outer tubular member, in which the opening adjacent the lock arm or the enlarged end portion of the lock member receiving means is aligned with the aperture to enable removal of the lock member on the first clasp member from the second clasp member or the insertion of the lock member through the aperture in the second clasp member.

Generally, the guide means includes at least one slot formed in and extending longitudinally from the second end of the inner tubular member and at least one pin mounted in a side wall of the outer tubular member and extending diametrically across the hollow bore in the outer tubular member to slidably engage the at least one slot in the inner tubular member.

In one embodiment, two diametrically opposed slots are formed on the second end of the inner tubular member. A single long pin is mounted across the second end of the outer tubular member or in a position spaced from the second end of the outer tubular member and extends through and across the diameter of the outer tubular member to engage the slots in the inner tubular member. Alternately, two shorter length pins are mounted in opposite sides of the side wall of the outer tubular member and extend co-linearly inward, with each pin engaging one of the slots in the inner tubular member. In another embodiment, a pair of opposed projections are formed in the side wall of the outer tubular member and extend inwardly into the interior of the outer tubular member to engage the slots or, preferably, a pair of recessed grooves formed in the inner tubular member.

Finally, various decorative elements, such as precious or semi-precious stones or other ornamentation, may be mounted on the end cap and the end cup for a pleasing, aesthetic appearance to the clasp consistent with the article, such as a piece of jewelry, on which the clasp is mounted.

In another embodiment, the first end of the outer tubular member is closed by means of a separate disk press fit into the first end or by having the first end of the outer tubular member integrally formed in a closed manner with the side wall of the outer tubular member. The closed end acts as a seat for the biasing spring which is inserted into the outer tubular member and is seated between the closed first end and one end of the inner tubular member. The guide means may be in the form of one or more slots or recess grooves formed in the second end of the inner tubular member. At least one and preferably a pair of tabs are movably formed in the second end of the outer tubular member and are deformable radially inward into engagement with one slot or groove in the inner tubular member to control the sliding movement of the inner tubular member within the outer tubular member as well as to limit the outward extension of the second end of the inner tubular member from the second end of the outer tubular member.

The present clasp overcomes certain problems encountered with previously devised clasps. The present clasp is of simplified construction thereby requiring less time and labor to assemble the clasp. Such simplified construction and the use of fewer parts and a more secure and stronger connection between the various components of the clasp provide a more rugged structure which increases the reliable long term use of the clasp. The stronger connection results from the use of a tubular inner member which has a large surface area at its ends for connection to the end cap and the press fit disk. In addition, the present clasp is extremely easy to grasp and operate through a natural position and movement of the user's thumb and index finger. At the same time, the clasp provides a high locking action which eliminates the need for a safety chain frequently employed with jewelry clasps. The clasp can also be embellished with decorative elements to integrate it with the article, such as a piece of jewelry, on which it is mounted.

BRIEF DESCRIPTION OF THE DRAWINGS

The various features, advantages and other uses of the present invention will become more apparent by referring to the following detailed description and drawing in which.

DESCRIPTION OF THE PREFERRED EMBODIMENTS

Figure 1:
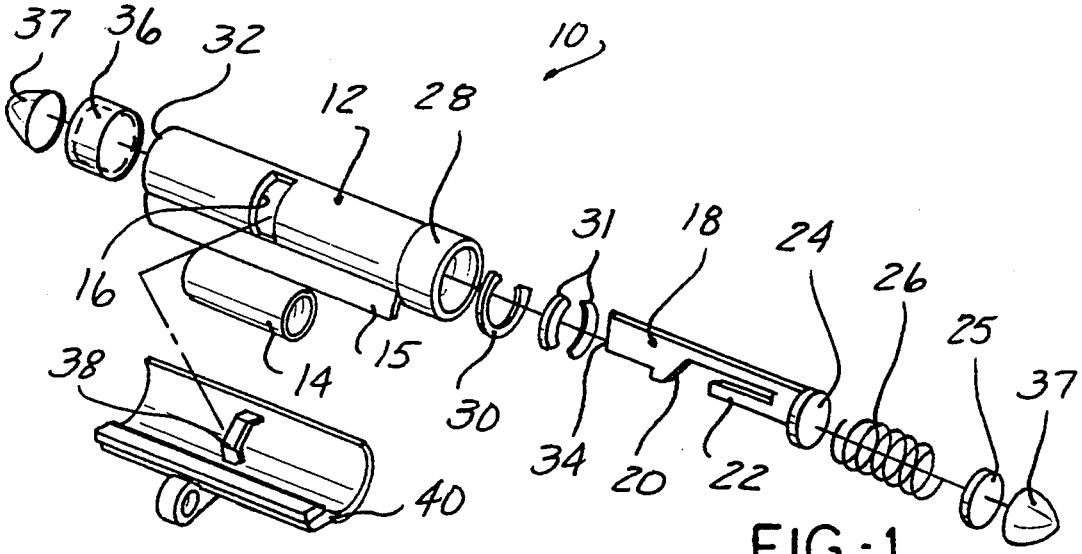
FIG-1 PRIOR ART
FIG. 1 is an exploded, perspective view of a prior art clasp.
Figure 2:
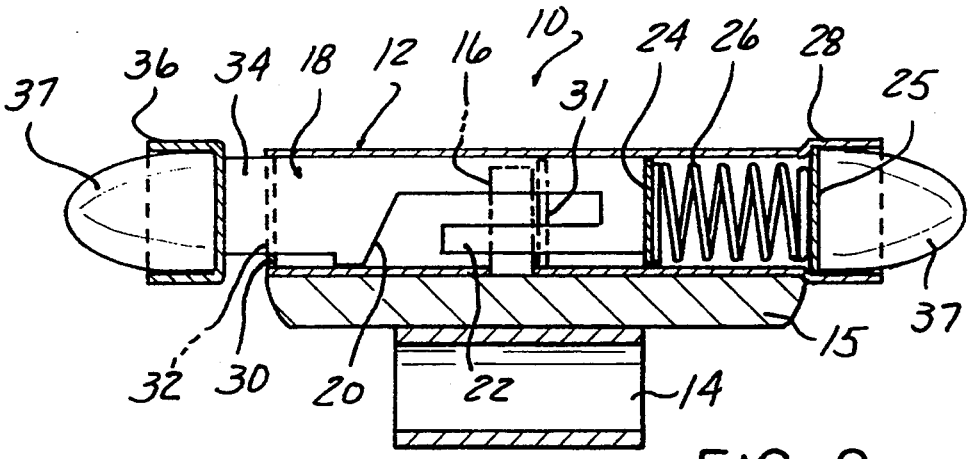
FIG-2 PRIOR ART
FIG. 2 is a side elevational view of the assembled prior art clasp of FIG. 1.
Figure 3:
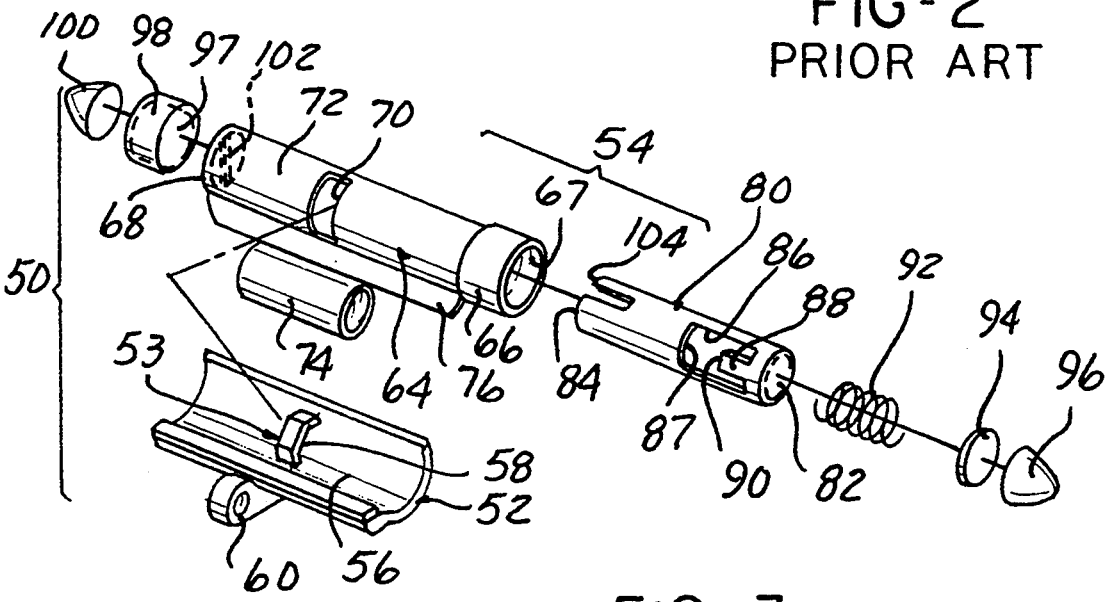
FIG. 3 is an exploded, perspective view of one embodiment of a second clasp member constructed in accordance of the teachings of the present invention.
Figure 4:
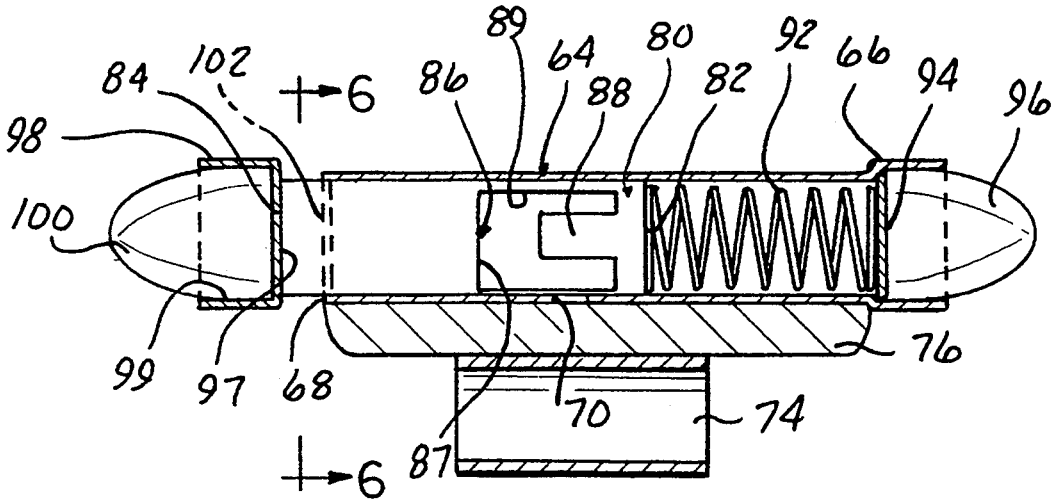
FIG. 4 is a partially cross sectioned, side elevational view of the outer tubular member of the clasp shown in FIG. 3.
Figure 6:
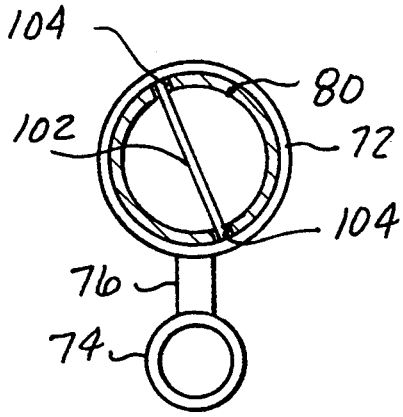
FIG. 6 is a cross sectional view generally taken along the line 6—6 in FIG. 4.

Referring now to the drawings, and to FIGS. 3 and 4 in particular, there is depicted one embodiment of a clasp 50 constructed in accordance of the teachings of the present invention. Although the present clasp 50 is described hereafter in conjunction with a piece of jewelry, such as a necklace, bracelet, watch band, etc., it will be understood that the clasp 50 has many other applications and can be used wherever two elements are to be releasibly connected such as a purse flap, belt buckle, coat pocket flap, to name a few.

In general, the clasp 50 is formed of first and second clasp members 52 and 54, respectively, which are releasibly interconnectible to secure opposite ends of a piece of jewelry, such as a necklace, bracelet, etc., not shown, together.

The first clasp member 52 is in the form of an arcuate or semi-circular shaped member having a lock member in the form of an arch-shaped lock ring 53 mounted on an interior surface 56. The lock ring 53 is in the form of a loop or ring having an aperture 58 formed therein. The lock ring 53 is soldered, welded or otherwise fixedly secured to the first clasp member 52. A joining member 60 in the form of a tube, pin, etc., is mounted to the exterior surface of the first clasp member 52 for receiving a pin or other suitable fastener for attaching the first clasp member 52 to one end of a piece of jewelry, not shown.

The second clasp member 54 includes an outer tubular member 64 having a generally circular cross section and a hollow interior bore extending completely therethrough. The outer tubular member 64 is formed with an end cup 66 having a first end 67, which end cup 66 is flared outward to a slightly larger diameter than the remaining cross section or diameter of the outer tubular member 64. A second end 68 of the outer tubular member 64 is opposed from the first end 67.

An arcuate shaped aperture 70 is formed through a side wall 72 of the outer tubular member 64 at a predetermined intermediate position between the first and second ends 67 and 68 thereof. The aperture 70 opens to the hollow interior of the outer tubular member 64.

A joining member 74 is secured to a planar flange 76 attached to and extending radially outward from the side wall 72 of the outer tubular member 64. The joining member 74, which may be in the form of a tube, pin, etc., is adapted to receive a pin or other suitable fastener for attaching the second clasp member 54 to one end of a piece of jewelry, not shown. Further, the flange 76 acts as a guide to align the first and second clasp members 52 and 54 during interconnection.

Figure 5:
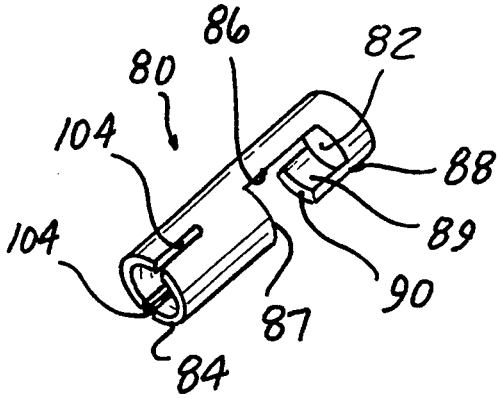
FIG. 5 is a perspective view of the inner tubular member of the clasp depicted in FIG. 3, but illustrated at a different angle.

An inner tubular member or slider 80, shown in FIGS. 3, 4, 5, 6, 8, 9 and 10 is slidably mounted within the outer tubular member 64. The inner tubular member 80 has a generally circular cross section with an O.D. slightly smaller than the I.D. of the outer tubular member 64 so as to be freely slidable through the outer tubular member 64 as described hereafter. The inner tubular member 80 is formed with first and second opposed ends 82 and 84, respectively. A generally U-shaped opening or notch 86 is formed in the side wall of the inner tubular member 80, generally adjacent to the first end 82 thereof, and forms a lock arm 88 which extends axially and integrally from the first end 82 toward the second end 84 of the inner tubular member 80. The lock arm 88 constitutes a lock member receiving means. The outer free end 90 of the lock arm 88 is spaced from an adjacent edge 87 of the side wall 72 of the inner tubular member 80 surrounding the notch 86 by a distance or gap at least as large as the width of the aperture 70 in the outer tubular member 64. For additional strength, the lock arm 88 is reinforced by a short length of half round wire 89 which is soldered to the interior side of the lock arm 88 as shown in FIG. 5.

The first end 82 of the inner tubular member 80 is closed by an end wall to form a solid exterior surface, as shown in FIG. 3. The first end 82 of the inner tubular member 80 acts as a seat for a biasing means 92, preferably in the form of a coil spring, which is disposed within the outer tubular member 64. A stop or disk 94 is press fit or otherwise fixedly mounted in the first end 67 of the outer tubular member 64 at a shoulder between the enlarged end cup 66 and the adjoining side wall 72 of the outer tubular member 64 to form another seat for the biasing spring 92. A decorative element 96, such as a precious or semi-precious stone, etc., may be mounted by adhesive or other suitable means in the first end cup 66 adjacent to or on the disk 94.

Figure 8:
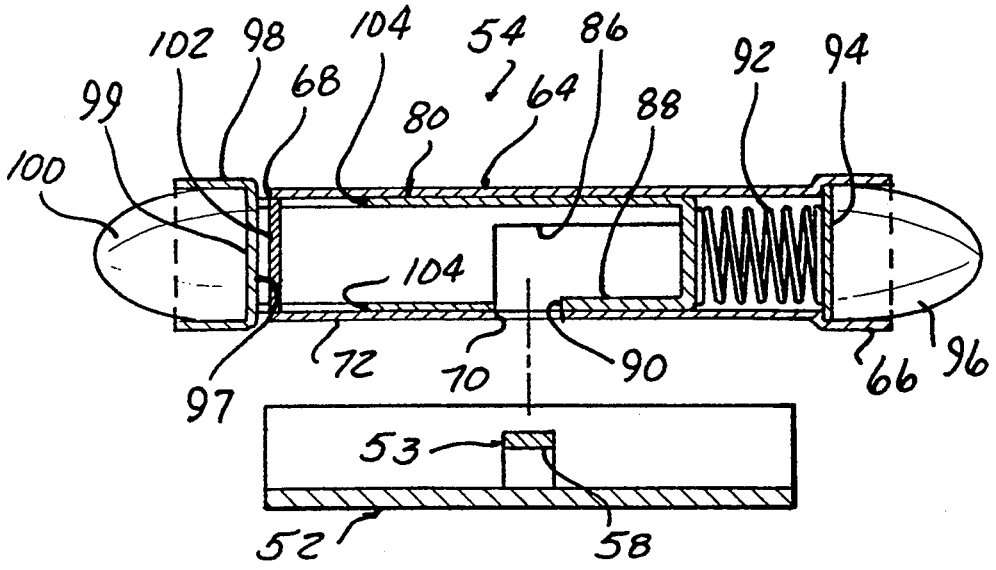
FIG. 8 is a partially exploded, longitudinal cross sectional view showing the interconnection of the two clasp members of the clasp shown in FIG. 3.
Figure 9:
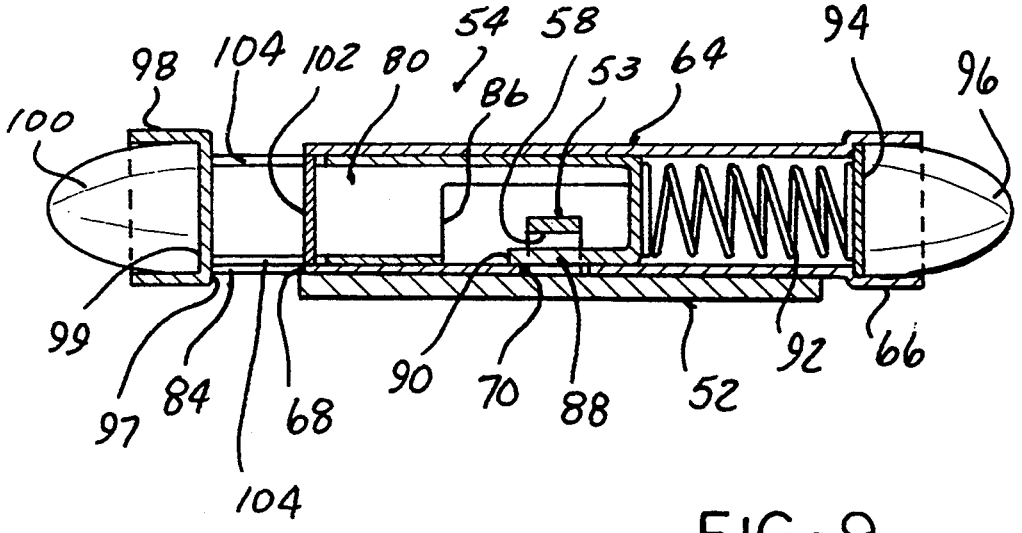
FIG. 9 is a longitudinal cross sectional view of the interconnected clasp members of the clasp shown in FIG. 3.

The opposite second end 84 of the inner tubular member 80 is fixedly connected by suitable means, such as by soldering, welding, etc., to a solid end 97 of an end cap 98. As shown in FIGS. 4, 8 and 9, the end cap 98 has a hollow interior 99 extending from the solid end 97 to an opposed open end. The end cap 98 is disposed exteriorly of and spaced from the second end 68 of the outer tubular member 64 when the inner and outer tubular members 80 and 64 are in their normal position, as described hereafter. Another decorative element 100 may be fixedly mounted by adhesive or other suitable means in the hollow interior 99 of the end cap 98, as shown in FIGS. 3, 4, 8 and 9.

Figure 14:
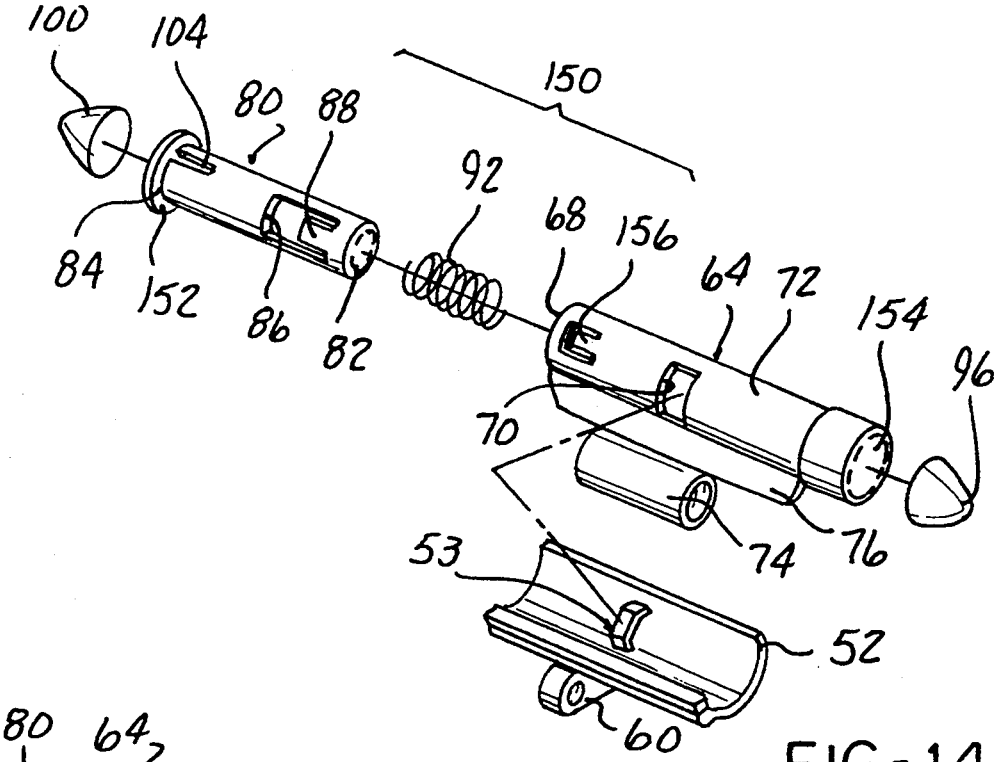
FIG. 14 is an exploded, perspective view of yet another embodiment of the clasp of the present invention.

Alternately, as shown in FIG. 14 and described hereafter, the end cap 98 may be formed of a thin, planar disk.

Figure 12:
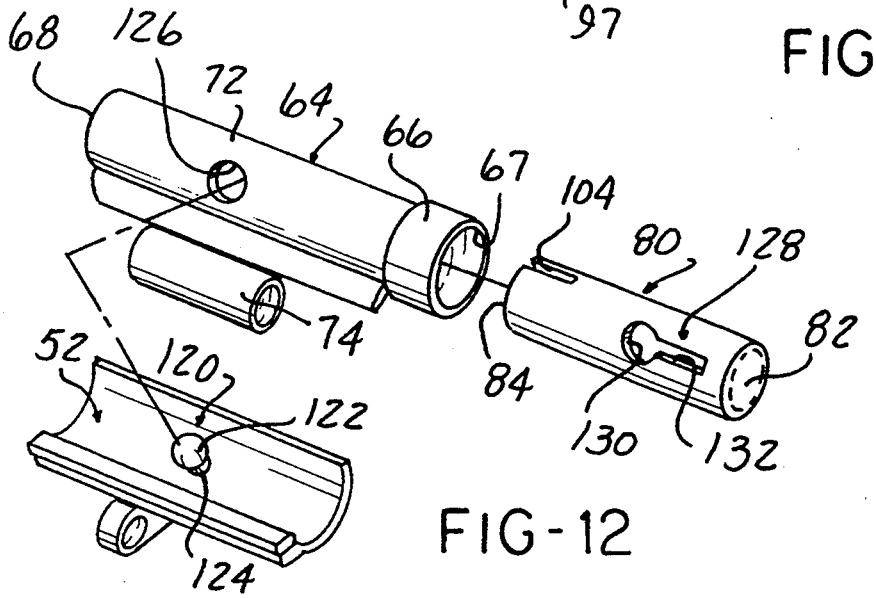
FIG. 12 is a partial, exploded, perspective view of alalternate embodiment of the clasp of the present invention.

In an alternate embodiment shown in FIG. 12, the lock member 120 attached to the first clasp member 52 is in the form of a spherical ball 122 which is mounted on a smaller diameter or cross-section stem 124 attached to the first clasp member 52 by soldering or other suitable means. An aperture 126 slightly larger than the diameter of the spherical ball 122 is formed in the side wall 72 of the outer tubular member 64 for receiving the spherical ball 122 therein.

The inner tubular member 80 is formed substantially the same as that described above and shown in FIGS. 3 and 4 except that the lock member receiving means is in the form of a keyhole slot 128 having an enlarged generally circular-shaped aperture 130 at a first end and a narrower slot 132 extending longitudinally therefrom toward the first end 82 of the inner tubular member 80. The circular aperture 130 is sized so as to slidably receive the spherical ball 122 when the first clasp member 52 is engaged with the outer tubular member 64 and the spherical ball 122 is inserted through the aperture 126 in the outer tubular member 64 and the inner tubular member 80 is biased toward the first end 66 of the outer tubular member 64 as described above. Release of the inner tubular member 80 will cause the slot 132 in the inner tubular member 80 to slide toward the second end 68 of the outer tubular member 64 to engage the stem 124 on the lock member 120 mounted on the first clasp member 52 and retain the first clasp member 52 in engagement with the outer tubular member 64.

Figure 13:
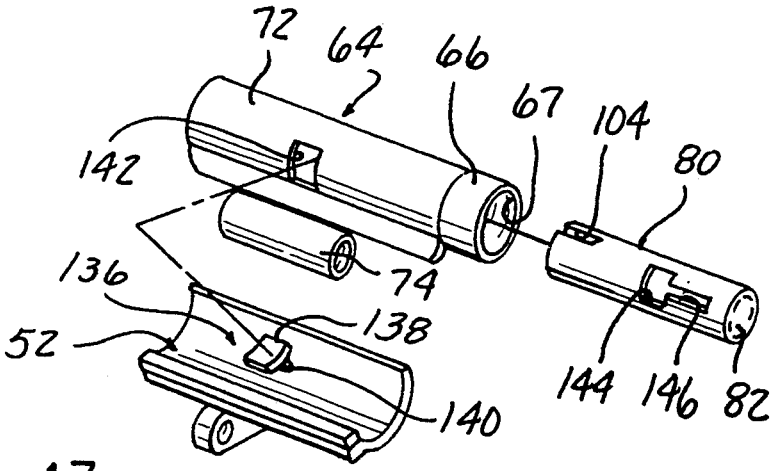
FIG. 13 is a partial, exploded, perspective view of yet another embodiment of the clasp of the present invention.

Another variation on the lock member and lock member receiving means is shown in FIG. 13. In this embodiment, the lock member 136 includes a polygonal-shaped, slightly arcuate member 138 which may have a square or rectangular cross-section. The polygonal member 138 is mounted on a narrow width stem 140 attached to the first clasp member 52. The aperture 142 formed in the side wall 72 of the outer tubular member 64 is complimentary in size and shape to the polygonal member 138. Similarly, the lock member receiving means formed in the inner tubular member 80 has an enlarged aperture 144 at a first end which is complimentary in shape to the polygonal member 138 so as to releasably receive the polygonal member 138 therein. A narrow width slot 146 extends from the enlarged aperture 144 in the inner tubular member 80 to slidably receive the stem 140 on the lock member 136 mounted on the first clasp member 52.

Guide means are provided for guiding the sliding movement of the inner tubular member 80 within the outer tubular member 64. In one embodiment, the guide means comprises a pin 102 which is fixedly mounted, as shown in FIGS. 3, 4, 6, 8 and 9, diametrically across the second end 68 of the outer tubular member 64, within the interior portion of the side wall 72 of the outer tubular member 64. The pin 102 engages a pair of diametrically opposed slots 104, shown in FIGS. 3, 5, 6, 8, 9, 12 and 13 which are formed in and extending axially from the second end 84 toward the first end 82 of the inner tubular member 80. The pin 102 and the slots 104 coact to limit the axial extension of the second end 84 of the inner tubular member 80 outward from the second end 68 of the outer tubular member 64 to a predetermined length as well as preventing rotation of the inner tubular member 80 within the outer tubular member 64 so as to provide proper orientation of the components of the clasp 50 of the present invention.

Figure 7:
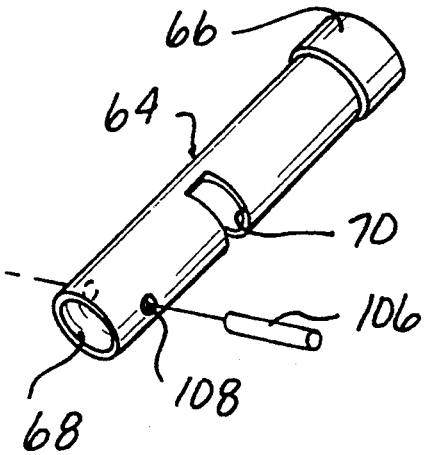
FIG. 7 is a partially exploded, perspective view of another embodiment of the outer tubular member of the clasp shown in FIG. 3.

Another embodiment of the guide means is shown in FIG. 7 in which a pin 106 is fixedly mounted in the outer tubular member 64 and extends through a pair of aligned apertures 108 formed on diametrically opposed portions of the side wall 72 of the outer tubular member 64. The pin 106 and the apertures 108 are spaced a short distance from the second end 68 of the outer tubular member 64. The pin 106 also slidingly engages the diametrically opposed slots 104 formed in the second end 84 of the inner tubular member 80.

Although the pins 102 and 106 have been described as a single pin having a length equal to the diameter of the outer tubular member 64, it will be understood that the guide means may be formed of a single shorter length pin and a single slot. Alternately, two co-linearly aligned, short pins may be mounted in opposite sides of the outer tubular member 64, with the pins extending radially inward to slidably engage two diametrically opposed slots 104 formed in the inner tubular member 80.

Figure 10:
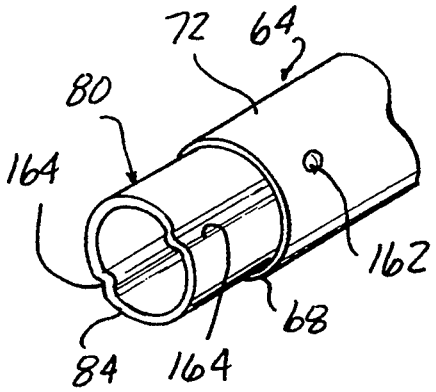
FIG. 10 is a partial, perspective view showing another embodiment of the guide means formed on the inner and outer tubular members.
Figure 11:
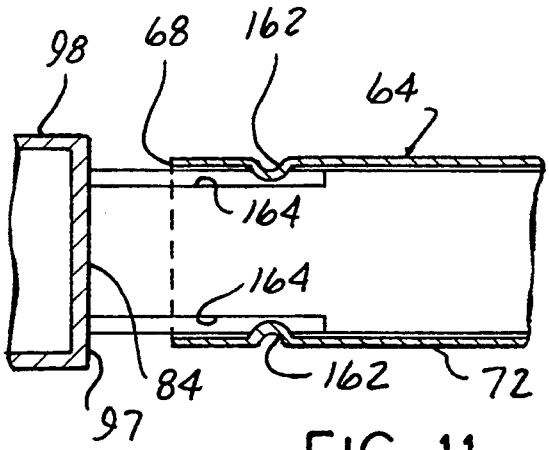
FIG. 11 is a partially cross sectioned, partial side elevational view of the alternate guide means depicted in FIG. 10.

Yet another embodiment of the guide means is depicted in FIGS. 10 and 11. In this embodiment, a pair of diametrically opposed, radially inward extending projections 162 are formed in the side wall 72 of the outer tubular member 64 and are spaced a predetermined distance from the second end 68 of the outer tubular member 64. The projections 162 can slidably engage the slots 104 formed in the second end 84 of the inner tubular member 80. However, it has been found that additional strength and a simplified manufacturing of the clasp can be achieved by replacing the slots 104 with a pair of diametrically opposed recessed grooves 164 which are formed by punching or by other suitable means in the inner tubular member 80. The grooves 114 extend axially from the second end 84 of the inner tubular member 80 for a predetermined distance and are slidably engaged by the projections 162 in the outer tubular member 64 to control the axial sliding movement of the inner tubular member 80 as well as to prevent rotation of the inner tubular member 80 within the outer tubular member 64.

In assembling the second clasp member 54 of the present invention, the outer tubular member 64 is constructed as described above, with the pin 102, the pin 106 or the projections 162 mounted adjacent the second end 68 thereof. The inner tubular member 80 is then slidably inserted into the outer tubular member 64 until the second end 84 of the inner tubular member 80 extends outward from the second end 68 of the outer tubular member 64 and the slots 104 engage the pin 102, the pin 106 or the projections 162, depending upon which embodiment of the guide means of the present invention is utilized. The second end 84 of the inner tubular member 80 extending outward from the second end 68 of the outer tubular member 64, as shown in FIGS. 4 and 9 is fixedly joined to the solid end 97 of the end cap 98 by soldering, welding, etc.

The biasing spring 92 is then inserted through the first end 67 of the end cup 66 into engagement with the first end 82 of the inner tubular member 80. The disk 94 is then press fit into the end cup 66 of the outer tubular member 64. The decorative members 96 and 100 may then be mounted in the end cup 66 and the end cap 98, respectively.

The normal position of the assembled clasp 54 of the present invention is shown in FIGS. 4 and 9. This is the normal or rest position of the clasp member 54. In this position, as shown in FIG. 4, the lock arm 88 extends across the aperture 70 in the outer tubular member 64.

In order to interconnect the first and second clasp members 52 and 54, the end cap 98 is moved toward the second end 68 of the outer tubular member 64 until it engages or is in close proximity with the second end 68 of the outer tubular member 64 as shown in FIG. 8. This sliding movement urges the lock arm 88 to the right, in the orientation shown in FIG. 8, until the free end 90 of the lock arm 88 clears the aperture 70 in the side wall 72 of the outer tubular member 64. In this position, the lock ring 53 on the first clasp member 52 can be slidably inserted through the aperture 70 in the side wall 72 into the interior of the outer tubular member 64 and through the gap in the inner tubular member 80 adjacent to the free end 90 of the lock arm 88. Due to the arcuate length of the aperture 70 in the side wall 72 of the outer tubular member 64, the correspondingly sized lock ring 53 will be centered within the aperture 70 in alignment with the lock arm 88 on the inner tubular member 80.

The above-described movement of the end cap 98 compresses the spring 92. Thereby, upon subsequent release of the end cap 98, the spring 92 expands and urges the inner tubular member 80 toward the second end 68 of the outer tubular member 64 such that the lock arm 88 slidably passes through the aperture 58 in the lock ring 53 on the first clasp member 52 to lockingly interconnect the first and second clasp members 52 and 54, as shown in FIG. 9. A subsequent movement of the end cap 98 toward the second end 68 of the outer tubular member 64 will again slide the lock arm 88 to the right out of engagement with the lock ring 53 to enable the first clasp member 52 to be separated from the second clasp member 54.

It should also be noted that during such bidirectional sliding movement of the inner tubular member 80 within the outer tubular member 64, the pin 102, the pin 106 or the projections 162 on the outer tubular member 64 remains engaged within the slots 104 or the grooves 164 formed in the inner tubular member 80 to guide the sliding movement of the inner tubular member 80, to maintain the required angular orientation of the lock arm 88 with the aperture 70 in the outer tubular member 64 so as to enable the lock arm 88 to slidably engage the lock ring 53 on the first clasp member 52, as described above, and to limit the axial extension of the second end 84 of the inner tubular member 80 out of the second end 68 of the outer tubular member 64.

Figure 15:
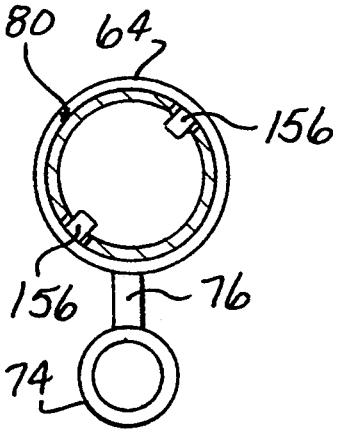
FIG. 15 is a lateral cross-sectional view of the left or second end of the assembled inner and outer tubular members shown exploded apart in FIG. 14.

Another embodiment of a clasp 150 constructed in accordance with the teachings of the present invention is shown in FIGS. 14 and 15. The clasp 150 is formed substantially the same as the clasp 50 described above and shown in FIGS. 3 and 4, such that identical components are described and depicted with the same reference numbers and new or different components have different reference numbers from the corresponding component in the clasp 50. Thus, the inner tubular member 80 is provided with an opening 86 which forms a lock arm 88 therein. At least one and preferably a pair of diametrically opposed guide slots 104 extend longitudinally from the second end 84 of the inner tubular member 80. The end cap 152, in this embodiment, is in the form of a thin, planar disk having a slightly larger outer diameter than the diameter of the inner tubular member 80. A decorative element or stone 100 may be mounted on the planar disk 152 by suitable means, such as an adhesive.

In this embodiment, the outer tubular member 64 has a closed first end 154. The closed first end 154 may be formed by fixedly mounting a disk in the originally open first end of the outer tubular member 64. Preferably, however, the first end 154 of the outer tubular member 64 is integrally formed as a closed end portion with the side wall 72 of the outer tubular member 64. A decorative elemental stone 96 may be adhesively mounted to the exterior surface of the closed end 154.

In assembling the clasp 150, the biasing spring 92 is initially inserted through the open second end 68 of the outer tubular member 64 until it seats against the closed end 154 of the outer tubular member 64. The inner tubular member 80 is then inserted through the open second end 68 of the outer tubular member 64 until the first end 82 of the inner tubular member 80 engages the biasing spring 92. The inner tubular member 80 is then forcibly urged into the outer tubular member 64 to compress the biasing spring 92.

The guide means of the clasp 150 includes at least one and preferably a pair of diametrically opposed tabs 156 which are cut into the side wall 72 of the outer tubular member 64 and spaced from the second end 68 thereof, as shown in FIGS. 14 and 15. The tabs 156 are provided in a number to correspond to the number of slots 104 or grooves 164 formed in the inner tubular member 80. The tabs 156 are forcibly deformed into the aligned slots 104, as shown in FIG. 15, after the inner tubular member 80 has been urged fully into the outer tubular member 64 to align the inner tubular member 80 in a predetermined angular orientation within the outer tubular member 64 as well as to control the amount of outward extension of the second end 84 of the inner tubular member 80 from the second end 68 of the outer tubular member 64 as described above.

Figure 16:
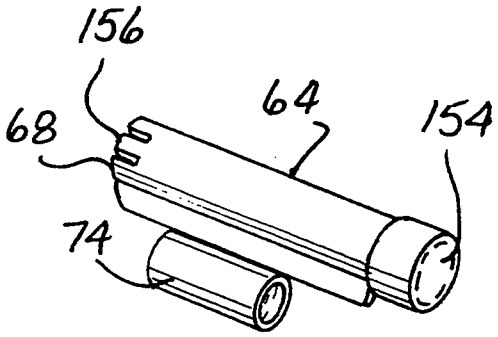
FIG. 16 is a perspective view of an alternate embodiment of the inner tubular member usable in the clasp shown in FIG. 14.
Figure 17:
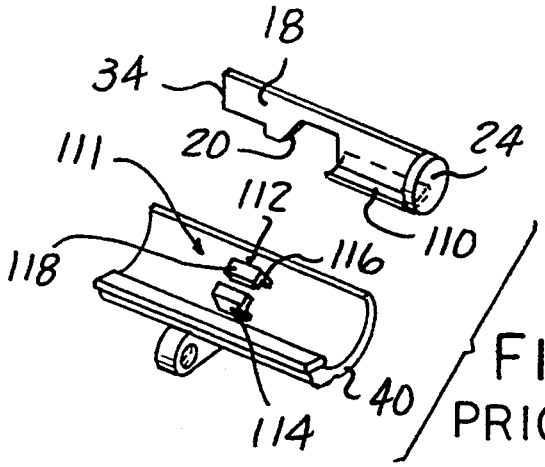
FIG-17 PRIOR ART
FIG. 17 is a partial, exploded, perspective view of another prior art inner tubular member and first clasp member usable in the clasp shown in FIG. 1.

In an alternate embodiment shown in FIG. 16, the tabs 156 may be formed directly at the second end 68 of the outer tubular member 64.

In summary, there has been disposed an improved clasp which has a simplified construction and fewer components than previously devised clasps so as to substantially reduce the assembly time of the clasp. In addition, the various components of the present clasp are strongly joined together to form a reliable clasp which still is easy to operate.

What is claimed is:

1. A clasp for releasibly interconnecting two movable members, the clasp comprising:

first and second releasibly interconnectible clasp members;

projection means mounted on a stem attached to and extending outward from the first clasp member;

the second clasp member including a hollow outer tubular member having a side wall and first and second opposed ends;

an aperture formed in the side wall of the outer tubular member between the first and second ends thereof for slidably receiving the projection means on the first clasp member therethrough;

an inner tubular member sliding mounted in the outer tubular member and having first and second opposed ends;

a slot formed in the inner tubular member, the slot having a first end portion for receiving the projection means therein and a second end portion for receiving the stem on the first clasp member;

means for forming a closed first end on the outer tubular member;

biasing means, mounted in the outer tubular member and seated between the closed first end of the outer tubular member and the first end of the inner tubular member, for biasing the inner tubular member toward the second end of the outer tubular member such that the second end of the inner tubular member normally extends outward from the second end of the outer tubular member and the lock member receiving means on the inner tubular member extends across the aperture in the side wall of the outer tubular member;

an end cap fixedly secured to the second end of the inner tubular member and disposed exteriorly of the second end of the outer tubular member; and guide means, mounted on the inner and outer tubular members, for guiding the sliding movement of the inner tubular member within the outer tubular member the guide means including:

guide projection means, mounted on and extending radially across the outer tubular member for engaging the inner tubular member; and a pair of guide projection receiving means, formed in the inner tubular member, for receiving the guide projection means;

the guide projection means and the guide projection receiving means extending over the full axial length of movement of the inner tubular member within the outer tubular member to prevent rotation of the inner tubular member relative to the outer tubular member; and wherein the guide means coacts with the biasing means to guide the inner tubular member between a first, normal position in which the second end of the inner tubular member extends outward from the second end of the outer tubular member and the second end portion of the slot in the inner tubular member is aligned with the aperture in the side wall of the outer tubular member to engage the stem on the first clasp member to interconnect the first and second clasp members, and a second position, upon movement of the end cap toward the second end of the outer tubular member, in which the first end portion of the slot in the inner tubular member is aligned with the aperture in the side wall of the outer tubular member to enable the free movement of the projection means on the first clasp member through the aperture in the side wall of the outer tubular member.

2. The clasp of claim 1 wherein:

the guide projection means includes a pin mounted in and extending diametrically across the outer tubular member; and the pair of guide projection receiving means includes a pair of diametrically opposed guide slots formed in the second end of the inner tubular member and coacting with the pin for guiding the sliding movement of the inner tubular member.

3. The clasp of claim 2 wherein:

the pair of slots have a predetermined length to limit the length of extension of the second end of the inner tubular member from the second end of the outer tubular member.

4. The clasp of claim 2 wherein:

the pin extends through aligned apertures formed in the outer tubular member and spaced from the second end of the outer tubular member.

5. The clasp of claim 1 wherein:

the guide projection means includes a pair of radially inwardly extending projections formed on the side wall of the outer tubular member, the pair of projections spaced from the second end of the outer tubular member; and the pair of guide projection receiving means includes a pair of grooves formed in and extending axially from the second end of the inner tubular member, each groove slidably engaging one of the pair of projections.

6. The clasp of claim 5 wherein:

the pair of projections are integrally formed with the outer tubular member.

7. The clasp of claim 5 wherein:

the pair of grooves are in the form of depressions integrally formed in the inner tubular member.

8. The clasp of claim 5 wherein:

the pair of grooves have a predetermined length to limit the length of extension of the second end of the inner tubular member from the second end of the outer tubular member.

9. The clasp of claim 1 further comprising:

decorative elements mounted on the end cap and the means for forming a closed first end of the outer tubular member.

10. The clasp of claim 9 wherein:

the end cup is integrally formed with the side wall of the outer tubular member.

11. The clasp of claim 1 further comprising:

an end cup mounted on the first end of the outer tubular member and forming an axial extension of the side wall of the outer tubular member; and the means for forming a closed the first end of the outer tubular member is a disk mounted in the end cup in registry with the first end of the outer tubular member.

12. The clasp of claim 1 wherein the means for forming a closed first end on the outer tubular member comprises:

a disk fixedly mounted on and closing the first end of the outer tubular member.

13. The clasp of claim 1 wherein the means for forming a closed first end on the outer tubular member comprises:

a closed end portion formed integrally with the side wall of the outer tubular member and forming a closed, continuous extension of the side wall of the outer tubular member.

14. The clasp of claim 1 wherein:

the projection means on the first clasp member includes a spherical ball mounted on the stem attached to and extending outward from the first clasp member, the stem having a smaller cross-section than the spherical ball; and the first end portion of the slot formed in the inner tubular member has a large diameter for receiving the spherical ball therein and a the second end portion of the slot has a smaller diameter than the first end portion and extends from the large diameter first end portion for receiving the stem.

15. The clasp of claim 1 wherein:

the projection means on the first clasp member includes a polygonal-shaped member mounted on the stem attached to and extending outward from the first clasp member; and the slot has an aperture at a first end portion complimentary to the shape of the polygonal member and a narrow slot portion in the second end portion extending from the first end portion for slidably receiving the stem.

16. The clasp of claim 1 wherein:

the pair of guide projection receiving means includes a pair of slots formed in and extending axially from the second end of the inner tubular member; and the guide projection means includes a pair of tabs formed in and integrally joined at a first end to the side wall of the outer tubular member, each tab having a freely movable second end deformable into one of the slots after the inner tubular member has been mounted in the outer tubular member.

17. The clasp of claim 16 wherein the second end of each tab is spaced from the second end of the inner tubular member.

18. The clasp of claim 16 wherein the second end of each tab is contiguous with the second end of the outer tubular member.

19. The clasp of claim 16 wherein:

the at least one slot comprises a pair of diametrically opposed slots formed in and extending from the second end of the inner tubular member; and the at least one tab comprises a pair of diametrically opposed tabs formed in the side wall of the inner tubular member, each tab being deformable into one of the slots after the inner tubular member has been mounted in the outer tubular member.

20. A clasp for releasibly interconnecting two movable members, the clasp comprising:

first and second releasibly interconnectible clasp members;

projection means mounted on a stem attached to and extending outward from the first clasp member;

the second clasp member including a hollow outer tubular member having a side wall and first and second opposed ends;

an aperture formed in the side wall of the outer tubular member between the first and second ends thereof for slidably receiving the lock member on the first clasp member therethrough;

an inner tubular member sliding mounted in the outer tubular member and having first and second opposed ends;

a slot formed in the inner tubular member, the slot having a first end portion for receiving the projection means therein and a second end portion for receiving the stem on the first clasp member;

means for forming a closed first end on the outer tubular member;

biasing means, mounted in the outer tubular member and seated between the closed first end of the outer tubular member and the first end of the inner tubular member, for biasing the inner tubular member toward the second end of the outer tubular member such that the second end of the inner tubular member normally extends outward from the second end of the outer tubular member and the lock member receiving means on the inner tubular member extends across the aperture in the side wall of the outer tubular member;

an end cap fixedly secured to the second end of the inner tubular member and disposed exteriorly of the second end of the outer tubular member; and guide means, mounted on the inner and outer tubular members, for guiding the sliding movement of the inner tubular member within the outer tubular member, the guide means extending over the full axial length of movement of the inner tubular member within the outer tubular member to prevent rotation of the inner tubular member relative to the outer tubular member; and wherein the guide means coacts with the biasing means to guide the inner tubular member between a first, normal position in which the second end of the inner tubular member extends outward from the second end of the outer tubular member and the second end portion of the slot in the inner tubular member is aligned with the aperture in the side wall of the outer tubular member to engage the stem on the first clasp member to interconnect the first and second clasp members, and a second position, upon movement of the end cap toward the second end of the outer tubular member, in which the first end portion of the slot in the inner tubular member is aligned with the aperture in the side wall of the outer tubular member to enable the free movement of the projection means on the first clasp member through the aperture in the side wall of the outer tubular member.

21. A clasp for releasibly interconnecting two movable members, the clasp comprising:

first and second releasbily interconnectible clasp members;

the first clasp member having a lock member extending outward therefrom;

the second clasp member including a hollow outer tubular member having a side wall and first and second opposed ends;

an aperture formed in the side wall of the outer tubular member between the first and second end thereof for slidably receiving the lock member on the first clasp member therethrough;

an inner tubular member sliding mounted in the outer tubular member and having first and second opposed ends;

lock member receiving means on the inner tubular member for lockingly receiving the lock member;

means for forming a closed first end on the outer tubular member;

biasing means, mounted in the outer tubular member and seated between the closed first end of the outer tubular member and the first end of the inner tubular member, for biasing the inner tubular member such that the second end of the inner tubular member normally extends outward from the second end of the outer tubular member and the lock member receiving means on the inner tubular member extends across the aperture in the side wall of the outer tubular member;

an end cap fixedly secured to the second end of the inner tubular member and disposed exteriorly of the second end of the outer tubular member;

guide means, mounted on the inner and outer tubular members, for guiding the sliding movement of the inner tubular member within the outer tubular member the guide means including:

guide projection means, mounted on and extending radially across the outer tubular member for engaging the inner tubular member; and a pair of guide projection receiving means, formed in the inner tubular member, for receiving the guide projection means;

the guide projection means and the guide projection receiving means extending over the full axial length of movement of the inner tubular member within the outer tubular member to prevent rotation of the inner tubular member relative to the outer tubular member; and wherein the guide means coacts with the biasing means to guide the inner tubular member between a first, normal position in which the second end of the inner tubular member extends outward form the second end of the outer tubular member and the lock member receiving means extends across the aperture in the side wall of the outer tubular member to engage the lock member to interconnect the first and second clasp members, and a second position, upon movement of the end cap toward the second end of the outer tubular member, in which the lock member receiving means is spaced from the aperture in the side wall of the outer tubular member to enable the free movement of the lock member on the first clasp member through the aperture in the side wall of the outer tubular member.

* * * * *